US007234699B2

(12) United States Patent
Putnam

(10) Patent No.: US 7,234,699 B2
(45) Date of Patent: Jun. 26, 2007

(54) FAMILY VACATION GAME

(76) Inventor: Anne Putnam, 68 Willowbrooke Dr., Orchard Park, NY (US) 14127

( * ) Notice: Subject to any disclaimer, the term of this patent is extended or adjusted under 35 U.S.C. 154(b) by 0 days.

(21) Appl. No.: 11/099,388

(22) Filed: Apr. 5, 2005

(65) Prior Publication Data

US 2006/0220315 A1 Oct. 5, 2006

(51) Int. Cl.
*A63F 3/00* (2006.01)

(52) U.S. Cl. ..... 273/242; 273/254

(58) Field of Classification Search ..... 273/242, 273/254

See application file for complete search history.

(56) References Cited

U.S. PATENT DOCUMENTS 4,344,625 A 8/1982 Frudakis
4,440,396 A 4/1984 Frudakis
5,102,143 A * 4/1992 Winkelman ..... 273/240
5,380,011 A * 1/1995 Jarvis ..... 273/254
5,405,140 A 4/1995 Terlinden et al.
5,813,671 A * 9/1998 Barratt ..... 273/251
5,931,469 A 8/1999 Stichnoth
6,267,375 B1 7/2001 Bernstein et al.
6,527,273 B1 * 3/2003 Dixson ..... 273/254
6,623,008 B1 9/2003 Reed, Jr. et al.

* cited by examiner

*Primary Examiner*—Vishu Mendiratta
(74) *Attorney, Agent, or Firm*—Patricia Costanzo

(57) ABSTRACT

A family vacation board game, designed to encourage family unity and cooperation and to help parents help children learn life skills, such as good decision making, comprises a board having a start space connected by game spaces to an end space. One player is chosen as banker. An amount of start-up currency is distributed to players and to the game banker. After family members choose a vacation designation and the total cost of the vacation, the play begins. Each player moves a representative token a number of spaces, determined by a throw of the dice, to be awarded or penalized according to play instruction presented on the game instruction spaces or according to instructions on a choice card given to a player landing on a choice card space. When all players reach the end space, they must determine if they have accumulated enough money to go on their dream vacation.

10 Claims, 5 Drawing Sheets

50

FAMILY VACATION BUDGET

Destination _____

Number of Family Members _____

Transportation

| | | | |
|---|---|---|---|
| Plane | ($250 per person) | = | _____ |
| Rent a car | ($200 per week) | = | _____ |
| Train | ($150 per person) | = | _____ |
| Your car | Gas and wear | = | _____ |
| Bus | | = | _____ |
| Taxi | | = | _____ |

Lodging

| | | | |
|---|---|---|---|
| Hotel | ($125 per night) | = | _____ |
| Condo | ($1000 per week) | = | _____ |
| Other _____ | | = | _____ |

Entertainment

| | | | |
|---|---|---|---|
| Amusement Park | ($50 per person) | = | _____ |
| Museum, Aquarium | ($20 per person) | = | _____ |
| Show | ($40 per person) | = | _____ |
| Sporting Event | ($50 per person) | = | _____ |
| Zoo | ($20 per person) | = | _____ |
| Other _____ | | = | _____ |

Food

| | | | |
|---|---|---|---|
| | $30 per person per day | = | _____ |

Souvenirs

| | | | |
|---|---|---|---|
| | | = | _____ |

TOTAL COST

| | | | |
|---|---|---|---|
| | | = | _____ |

These prices are suggested costs. You may need to alter them based on destination, type of lodging/restaurant and duration of trip.

Good Luck!

FIG. 5

FAMILY VACATION GAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND

The present invention relates generally to board games and, more particularly, to a board game that is designed to develop family cooperation while providing players with opportunities to improve their financial skills and decision making abilities.

The background information discussed below is presented to better illustrate the novelty and usefulness of the present invention. This background, information is not admitted prior art.

One of the greatest satisfactions a parent can have is to know that they are effectively helping their children to be responsible, mature, successful individuals. Although most parents are more than willing to invest whatever amount of time is required to teach their children good life skills, they do not want their children to think of them only as instructors. Parents want to enjoy the company of their children and hope that their children will also enjoy the time they spend with their parents. Thus, parents would greatly appreciate a product and/or a process that would allow them to help their children develop positive life skills and to do so in a way that results in their children enjoying their participation in the teaching/learning experience.

Knowing how to make good decisions and how to manage money are two of the more important life skills. Having such skills is perhaps more important to children in today's world than it ever has been before. Researchers have found that children and teenagers have a tremendous impact on spending decisions. In addition to playing such a large role in how their parent's money is spent, youngsters spend enormous sums of their own money. Researchers estimate that children spend about $200 billion dollars a year and influence another $250 billion dollars of household purchases. Clearly, children need to be educated on how to spend money sensibly. Children also need to learn the importance of saving money.

Children are capable of developing positive attitudes about money, and, with some help, they can learn how to plan their spending and savings to meet their needs and financial goals. People, including young people, learn better and faster when involved in real spending and savings deliberations and decisions and subsequently having to live with the consequences of those decisions. It is often difficult, though, to find appropriate opportunities for children, especially young children, to be involved in making real family financial decisions. Most experts agree that teaching children skills required for financial independence can be one of the toughest parenting undertakings there is. Children, especially very young children, cannot be allowed to decide which house or automobile the family will purchase. Nor are they prepared to comparison shop and to make buying choices. Having a child simply observe an adult's decision making process often results in a bored and disinterested child. In order to remain interested participants in a decision making exercise, children usually need to be involved in making decisions that will, in some way, impact them. Parents and other teachers struggle, often unsuccessfully, to identify mechanisms that can assist them in teaching children financial skills that will help them avoid financial problems as adults. Thus, it is clear that what is sorely needed is a means that can be used to help children learn to make good choices, especially when the choice is an economic one.

Young people who learn good money management skills are more likely to become adults who can make sound financial decisions, use credit wisely, invest in retirement plans, avoid excessive debt, and manage income and expenses to reach their financial goals. Teaching children at an early age the value of money can eventually reap rewards for the children, their parents, and for society as a whole. Understanding how money is used in exchange for things that are needed or wanted should form a part of a child's education from before the time he or she enters grade school and through high school. Different approaches, however, work better at different ages. Thus, it is appreciated that what is needed is a means that will allow children of various ages to participate in and learn from making choices that have economic and other kinds of consequences.

Parents are their children's first and arguably most effective teachers. Even more important than lessons learned from their parents teaching are the lessons children learn from their own successes and failures in spending money. These achievements, or failures, usually make lasting impressions on young decision makers and, thus, impact their future decisions. One way to give children experience in making financial decisions is to involve children in the family's financial decisions, especially in those situations where the decision will affect each member of the family. Such a situation might be in the planning of a family vacation, especially when the vacation choices must be guided by a defined budget. Family vacations, however, usually take place only once a year which limits their use as teaching opportunities. It is appreciated then that what is sorely needed are means to help parents teach their children how to make sound financial decisions where the means are available as often as, and when, needed.

It is well-accepted that actions often speak louder than words. When children see first-hand that good decision making, such as making a decision to save money, can result in some kind of rewarding experience, they are more apt to remember that lesson. It is not always easy to save, even for adults, unless there is a clear incentive for doing so. To more fully engage the interest of their children, parents could contemplate sharing their financial goals with their children, especially those financial goals that will impact all family members, such as saving to buy a house, a car, or for the family to go on a vacation. This can give kids a meaningful reason to save. However, buying a house, a car, or even going on a family vacation are usually relatively rare events and do not occur frequently enough to be dependable teaching tools. What is needed are readily available means to give children an incentive to want to save for something that is important to them.

Parents are advised to use every opportunity possible to teach their children smart money management. Such opportunities include having children learn to read labels, to ask questions of the sales clerks when the information they need is not on labels or when the information is unclear, and to recognize a "good" buy by taking the children with them when shopping and explaining one item over another will be the choice. These types of activities should be followed-up by offering guidance and suggestions to children when they are doing their own shopping. These can be simple and effective strategies, but they often may not be workable. In most of today's families, one or both parents are away from home working during day-time shopping hours and children are in school. In the evening parents are tired and have to get the family ready for the next day while the children often need at least part of the evening to complete their homework assignments. What would be appreciated are means to help children become good money managers that can accommodate everyone's schedules.

When parents encourage children to participate in family discussions on how to spend the family's income, children are more likely to develop a deeper and more accurate understanding and appreciation of their family's expenses and help children understand that their wants and needs are only part of what the family's income must cover, thus enabling the children to more fully and willingly cooperate with the family's economic decisions, such as making last year's wardrobe do for another year and keeping the home thermostat turned down to save on heating costs. Children may also be kept involved by allowing them to help keep the family's financial records, writing checks, and participating in discussions about the family's insurance program. As helpful as these suggestions are they can be difficult to implement. It is unrealistic and unfair to expect children to be able to make adult spending decisions. Keeping family records is tedious yet demands great attention, something that is difficult for children to do. Writing checks is often not something parents are willing to allow children to do and even so, after the first few check writing experiences, children often lose their interest in these kinds of activities. What is needed is a product and/or a process capable of helping children of various ages learn fiscal responsibility and good decision making skills and is amendable to the needs and desires of both the parents and the children.

Learning to make good choices, often is proceeded by the pain of making mistakes. Even as adults, we often make poor choices. Making poor choices, such as making a poor spending decision may likely result in an uncomfortable experience, but it also can be a valuable and remembered lesson. As adults, though, we should strive to offer children chances to make mistakes that are significant as learning tools, but that are not unduly burdensome or punitive. What would be of considerable benefit to parents in this respect would be a means to allow children to make decisions that have meaningful but not disastrous consequences for them.

Learning to make good decisions is only part of learning to be fiscally responsible. Children also need to learn how to keep records. So as not to overwhelm a child's abilities, record keeping kept should be simple and should be, at least in part, the child's idea. The act of keeping simple records will provide for children to gain an understanding of where their money comes from and where it goes. Keeping records enables a child to monitor step by step how their pay or allowance can just slip away unless something is done to keep track of it and plan its use. A good money management teaching tool would include a budget that could be used by youngsters of various ages.

Thus it is clear that there is an unmet need for a product and/or a process that encourages family members to spend more time enjoying each other's company, provides ways to strengthen family bonds, and helps parents help their children develop positive life skills. Such a product and/or a process should provide ways to help children learn to make good choices, especially in those cases where the choices are economic, and should do so for children of various ages. The learning should involve making choices that have consequences that are meaningful to the children making the choices. Not only should the means educate children on how to spend money sensibly, they should also help children to appreciate the benefits of saving money. Moreover, such means should be available as often as, and when, needed thus, being able to accommodate the schedules of both parents and children. Moreover, a good money management and decision making teaching tool should include a budget making tool designed for use by youngsters of various ages.

SUMMARY

Accordingly, the present invention gives parents a way to help their children develop useful life skills and does so in a way that results in the children enjoying their participation in the teaching/learning experience. The life skills that that are meant to be taught and tested by the principles of the invention include good decision making abilities, knowing how to spend sensibly, and having an appreciation of the benefits of saving, whether the savings are simply for a "rainy day", a college fund, or even to go toward a retirement fund. Moreover, the invention provides for the means and methods to be available as often as, and when, needed. The means and methods, as described, provide for children of various ages, from preschool to young adult, to participate in and learn from making choices that have economic and other kinds of consequences. Of considerable benefit, is that the means and methods provide for children to make decisions that have consequences that are important to them, but that are not disastrous or punitive. Additionally, the present invention provides means and methods for teaching children the value of making and keeping a budget. Moreover, the invention offers all of these benefits and advantages while encouraging family interaction and cooperation.

Accordingly, the present invention teaches a family vacation board game wherein each family member participates in deciding where the family will go on its dream vacation. This decision making exercise can be a pre-extension of the game and include family visits to libraries, travel agencies, and the Internet, for example, to research ideal vacation destinations and the costs that are likely to be associated. Such activities provide ways for family members to spend more time enjoying each other's company. Additionally, while participating in the game and in the pre-game activities, each family member is provided with opportunities to demonstrate their decision making abilities to the rest of the family. Family members get a chance to recognize and appreciate each other's talents and how they can contribute to the effectiveness of family as a unit. Thus, while providing for family fun, the invention also provides for ways to strengthen family bonds, and all the while, helps parents help their children develop positive life skills.

Once the vacation destination and cost have been decided, family members determine a vacation budget that includes all of the costs involved including unplanned for expenses. Budget sheets may be included as a game element and may be used to help family members decide how much money the family, and each member, is willing, and perhaps able, to spend on their vacation. The goal of each family member is to assess and then contribute their share to the vacation fund so at the end of the game the family will have amassed the amount of money required for their vacation, as was determined in the budgeting step.

Once a budget is determined the play begins by having family members use a chance means, such as a pair of dice to determine the order of play and the number of spaces traversed by each player in their turn. Each player chooses a player token to mark their place on the board as the play progress. In brief, the goal is for each family member to start from the game's start space and to work their way, in turn, along a play path of game spaces or steps to the end of the game which is marked as the vacation destination. At the beginning of the play, each member will be allocated a predetermined amount of play currency that will be augmented or diminished as the play progresses by instructions given on any particular game space or as a consequence of a player's decision that must be made according to instructions on a choice card. Play continues until all family members have reached the end space. At that time, each player's contribution to the vacation fund is counted and added to the total to see if the amount the family needs to go on their vacation has been accumulated.

All of the above described features, and more, are presented by providing for a method of playing a family vacation board game, wherein family members plan and play to save a predetermined amount of game currency required for the family members to go on a dream vacation, comprising the steps of:

a) providing a game board having a start space, an end space, and a path having a plurality of game spaces leading from the start space to the end space, wherein a play instruction is present on each of the game spaces;
b) providing a first chance means, wherein the first chance means may be a set of dice;
c) providing a set of tokens where each of the tokens represents a player and the player's space position on the path;
d) choosing a player to be a game banker responsible for distributing the game currency;
e) providing a predetermined amount of game currency to each player and a predetermined amount of the currency to the game banker;
f) providing a plurality of reward choice cards and a plurality of penalty choice cards, respectively providing rewards and penalties during the play, the reward or penalty comprising a reward or penalty of a predetermined amount of the game currency to be distributed or collected, respectively by the game banker;
g) players selecting a vacation destination;
h) players determining the vacation expense;
i) players selecting a first player;
j) having first through subsequent players each move their player space position token sequentially along the game path spaces in turn according to a number indicated by the first chance means wherein each player must follow the play instruction given on the game space reached or must follow the play instruction given on the choice card allocated by the game space instruction;
k) awarding or penalizing players according to the play instruction presented on the game space or presented on the choice card, and
l) when all players reach the end space, determining if the predetermined amount of money required for the family to go on their dream vacation has been accumulated by the players.

Wherein determining a cost for the vacation may include determining a budget for all trip costs and providing for some potential unexpected costs. A budget sheet may be used, as desired, to determine the budget for all trip costs.

In a preferred embodiment the end space of the board game comprises a map on which vacation sites are indicated. The map may be a map of any desired area, for example the map may be a state map, a country map, or a world map. In some instances, the map may be a map of the solar system, the galaxy, or even outer space.

After all players reach the end space, and all players money is added together, and the total amount is equal to or greater than the predetermined amount of game currency required for the family members to go on a dream vacation, the family is deemed to have earned their vacation.

It is also contemplated that after all players reach the end space, and all players money is added together, and the total amount is less than the predetermined amount of game currency required for the family members to go on a dream vacation, the family must either play again, re-budget their vacation, or accept the fact that they will not be able to go on their dream vacation.

Moreover, in another preferred embodiment, the first player is deemed to be the youngest player of the playing group.

In yet another preferred embodiment, when all of the players have reached the end space, the players are allocated interest from the bank on any game currency that the players placed into a savings account.

In yet still another preferred embodiment, one side of the playing board is marked for use as the bank.

Additionally, a further preferred embodiment teaches a family vacation board game, wherein family members plan and play to save a predetermined amount of game currency required for the family members to go on a dream vacation, comprising:

a) a game board having a start space, an end space, and a path having a plurality of game spaces leading from the start space to the end space, wherein a play instruction is present on each of the game spaces;
b) a first chance means;
c) a set of tokens where each of the tokens represents a player and the player's space position on the path;
d) a player who is chosen to be a game banker responsible for distributing the game currency;
e) a predetermined amount of game currency provided to each player and a predetermined amount of the currency provided to the game banker;
f) a plurality of reward choice cards and a plurality of penalty choice cards, respectively providing rewards and penalties during the play, the reward or penalty comprising a reward or penalty of a predetermined amount of the game currency to be distributed or collected, respectively by the game banker;
g) a player determined vacation destination;
h) a player determined vacation expense;
i) players selecting a first player;
j) wherein first through subsequent players each move their player space position token sequentially along the game path spaces in turn according to a number indicated by the first chance means wherein each player must follow the play instruction given on the game space reached or must follow the play instruction given on the choice card allocated by the game space instruction;
k) wherein players are awarded or penalized according to the play instruction presented on the game space or presented on the choice card, and l) wherein when all players reach the end space, determining if the predetermined amount of money required for the family to go on their dream vacation has been accumulated by the players.

Still other benefits and advantages of this invention will become apparent to those skilled in the art upon reading and understanding the following detailed specification and related drawings.

BRIEF DESCRIPTION OF THE DRAWINGS

In order that these and other objects, features, and advantages of the present invention may be more fully comprehended and appreciated, the invention will now be described, by way of example, with reference to specific embodiments thereof which are illustrated in appended drawings wherein like reference characters indicate like parts throughout the several figures. It should be understood that these drawings only depict preferred embodiments of the present invention and are not therefore to be considered limiting in scope, thus, the invention will be described and explained with additional specificity and detail through the use of the accompanying drawings, in which:

FIG. 5 is a plan view of an example of a family vacation game budget sheet.

Figure 1:
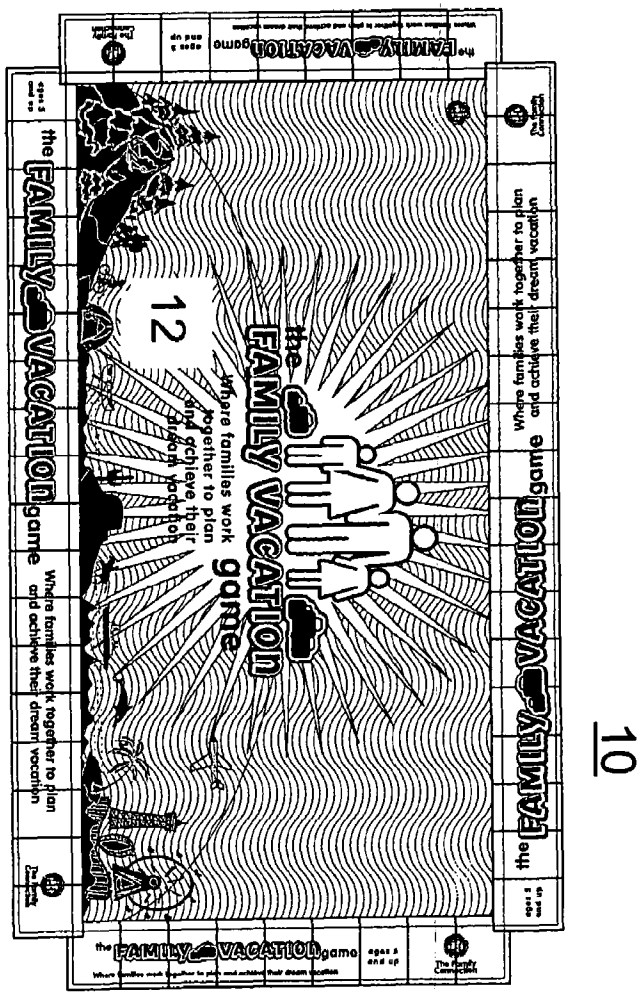
FIG. 1 is a top plan view of an unfolded box cover of the Family Vacation Game describing the game's concept of having family members work as a team to achieve their dream vacation.

A List of the Reference Numbers and Parts of the Invention to which Numbers Refer

10 An exemplary box cover for a box used to store a game board of the present invention, which cover has its sides folded out for illustration purposes.

12 The objective of the family vacation game as printed on the exemplary cover 10.

20 A game board of a preferred embodiment of the present invention.

22 Starting space.

23*a* Family choice card game space, which when landed on by a player requires that player to draw a choice card.

23*b* Space on which the family choice cards to be drawn by players are kept during the game.

24 End space, which in this embodiment is depicted as a map of the contiguous United States.

25 One of many reward instruction spaces, which when landed on by a player, presents the player with a reward instruction.

26 One of many penalty instruction spaces, which when landed on by a player, presents the player with a penalty instruction.

28*a* A section of the game board that may be used as a banker's drawer.

28*b* A section of the game board that may be used as a savings account holding place.

30 A side of a family choice card displaying the logo of the family vacation game.

32 A side of a family choice card describing a behavior that earns a reward and the reward earned.

34 A side of a family choice card describing another behavior that earns a reward and the reward earned.

36 A back side of a family choice card describing a behavior that earns a penalty and the penalty earned.

38 A back side of a family choice card describing another behavior that earns a penalty and the penalty earned.

40 An example of game playing currency.

50 An example of a Family Game budget sheet.

DEFINITION SECTION

Saving account, as used herein, may refer to a typical savings account, a retirement savings account, a college fund savings account, or any other type of savings account.

It should be understood that the drawings are not necessarily to scale, for example the one front side illustration of a family vacation game choice card is presented as larger than each of the four back side illustrations of family vacation game choice cards, whereas in realty the front side and the back side of such cards have equal dimensions. In certain instances, details which are not necessary for an understanding of the present invention or which render other details difficult to perceive may have been omitted.

DETAILED DESCRIPTION

Referring now, with more particularity, to the drawings, it should be noted that the disclosed invention is disposed to embodiments in various sizes, shapes, and forms, examples of which will be presented below. Therefore, the embodiments described herein are provided with the understanding that the present disclosure is intended as illustrative and is not intended to limit the invention to the embodiments described herein.

The present invention is directed towards a family vacation game. The family vacation game is different from most other board games known to Applicant, in that, among other things, the game encourages families to play as a family unit where family members cooperate and support each other's moves instead of competing against one another. The winning strategy of the game provides for win-win situations instead of win-lose scenarios. One objective of the game is to engage all family members in choosing a vacation destination that will appeal to all members of the family. The choice can include a decision making process as complex or simple as the playing members like. In one embodiment, family members are assigned a vacation research project. The research may include trips to the library, a travel agency, virtual trips to vacation sites and to the Chamber of Commerce of a given site, as well as a comprehensive Internet search. Once all of the results of the research have been collected, the family may spend some time perusing the information gathered before the vacation designation is determined. In one favored embodiment, once the family chooses their vacation designation, the family's next step is to determine the total cost of their vacation and how much each family member will try to contribute toward the total cost. Determining the total cost may also be as complex or as simple as the family likes. When time is short, but the family would still like to play the game, the family might decide on a arbitrary amount that is needed to cover the cost of a vacation and then pay the game on that basis. However, if the family would like to simulate realty and has the time to do so, the family might do some real cost research, such as the cost differences between flying, taking a train or a bus, or driving to the vacation destination. The hotel or motel rates would be included or compared to what it would cost to rent a travel home to avoid hotel costs and to keep eating-out costs to a minimum. The family could debate if going through the trouble of packing lunches was worth saving enough money to spend a day in a favored theme park. The budget process might include making decisions as to how much each family member would like to or is able to contribute to the vacation fund. Once the financial aspects of the vacation are determined, each member receives a start-up vacation fund which can be increased or decreased depending on which spaces a player lands as the player travels along the game path. During game play, each player tries to accumulate his or her share of the vacation cost. As each player traverses the path of game spaces, he or she is presented with various life situations. Some of the situations encountered during play will earn a player a reward while other situations will earn a player a penalty. In addition, there are spaces that direct a payer to take a "choice card." Each choice card presents a life situation which is either good or bad for the family. A situation that is good for the family results in a monetary reward and a situation which is not good for the family results in a penalty. Play continues until every family member travels the game path to the end space, which in the embodiment illustrated is a map of the United States of America, but, of course, could be a map of anywhere desired. When everyone has reached the end space, the currency accumulated during play is totaled. If the currency accumulated is equal to or greater than the total cost of the trip, the family gets to go on their dream vacation. If not enough currency has been accumulated, the budget must be revised to reduce some costs, the game must be played again, or the family must give up going to their dream vacation. Thus, it is easy to appreciate that where most board games encourage and rely on a highly developed sense of competition, The Family Vacation Game promotes a cooperative family interaction that aims to have the whole family unit being the winner.

In this example which is a favored embodiment, the Family Vacation Game comprises a family game board, a chance means which could be a set of dice or a spinner assembly, a set of tokens used as indicia to identify the individual players, game currency, a set of family choice cards, and, if desired, a set of family vacation game budget sheets which may provide suggested vacation costs, but allow for the costs to be adjusted based on destination, type of lodging/restaurant/activities, and duration of the vacation. Game currency is managed by the banker who is a family member that is chosen by the other family member to be responsible for the collection and distribution of funds.

Turning now to the drawings, FIG. 1, a plan view of unfolded box cover 10, illustrates text 12 expressing the game's objective of having family members work together to achieve a dream vacation. Once the destination of the family's dream vacation has been determined, the total cost of the vacation should be calculated. To assist players in determining the total cost of their vacation, the players may use a Family Game budget sheet 50 (as illustrated in FIG. 5).

After the cost of the vacation has been determined, one family member must be designated by the remaining family members to act as the banker. Once designated, the banker must distribute game starting funds to each player, which in this embodiment is a sum of $300 per player. Next, the order of play among the players is determined. This can be accomplished by either using a dice chance means or a spinneret chance means. If a dice means is used, then the family must decide is the player who throws the highest or the lowest number on the dice will be the first player. If a spinner means is provided, the face of the spinner card would present spaces for the spinner to land on that designate which family member will be the first, the second, and so on. At this point, the play is ready to begin.

Figure 2:
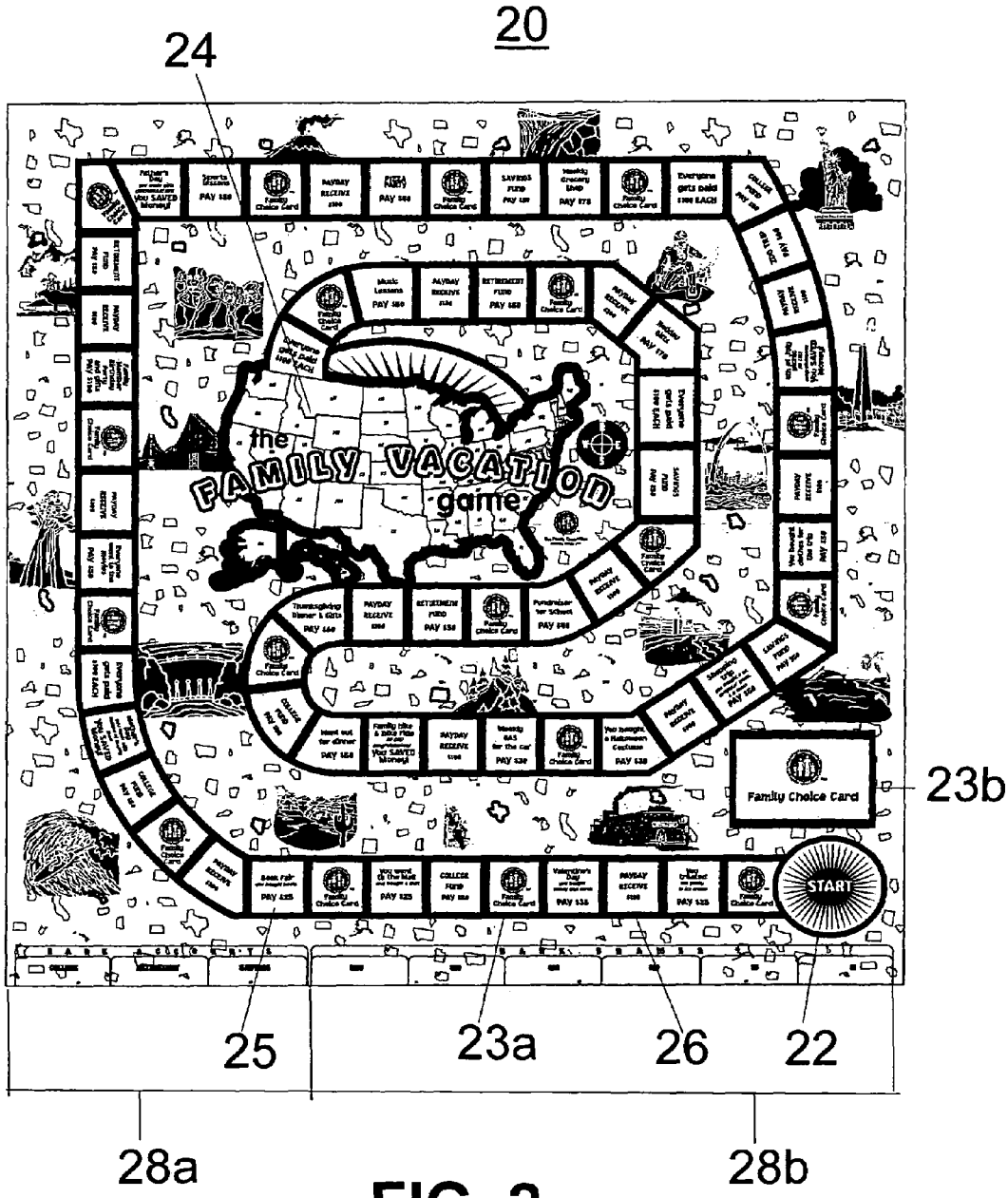
FIG. 2 is a plan view of the present game board exemplifying features of the game.
Figure 4:
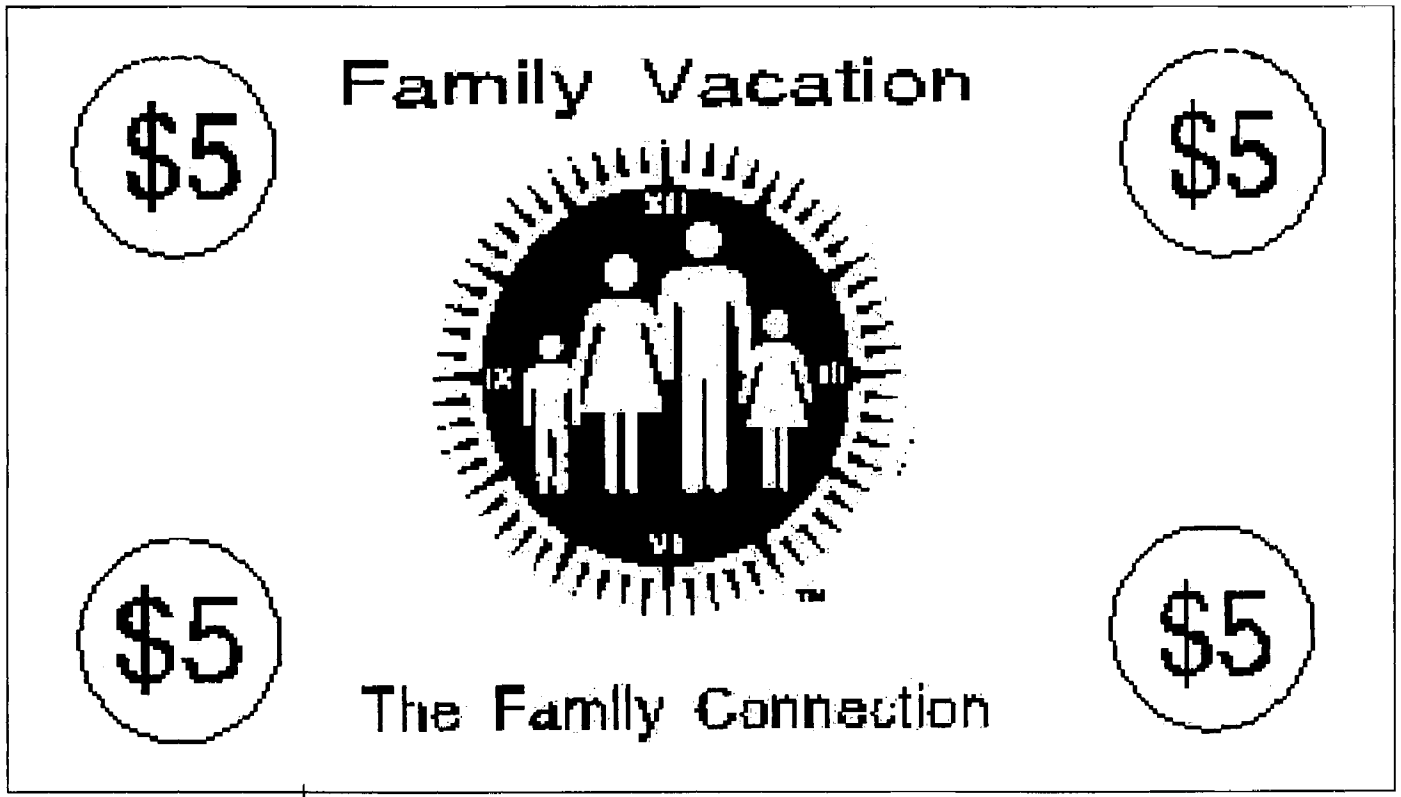
FIG. 4 is a plan view of an example of family vacation game money.

The game includes game board 20, as illustrated in FIG. 2, which shows major features of the game. The play on game board 20 starts when using a chance means, such as a pair of dice, the first player determines how many game spaces on board 20 he or she should move as counted from game start space 22 toward game end space 24. During the play, each player will land on game spaces that simulate life situations likely to be encountered in real life by the players. Each situation will cause a player to accumulate or to lose some of his or her vacation funds. If, for example, the chance means indicates the player should move three spaces from start space 22 along the game path of spaces, the player will land on game space 26 which presents players with a reward instruction, which in this case is a "Payday" space that allows the player to receive $100 from the bank. The banker may keep game currency 40 (illustrated it FIG. 4) in the spaces designated as banker's drawer 28*a*. If, however, the chance means indicates the player should move nine spaces from start space 22 along the game path of spaces, the player will land on game space 25 which presents players with a penalty instruction, which in this case penalizes the player $25 for spending money at a book fair. In this instance, the player will have to give $25 to the bank. If the chance means indicates the player should move to a family choice card game space, such as the one indicated by reference numeral 23*a*, the player will be required to draw a family choice card from the deck of family choice cards that during the play of the game are kept on family choice card space 23*b*.

Figure 3:
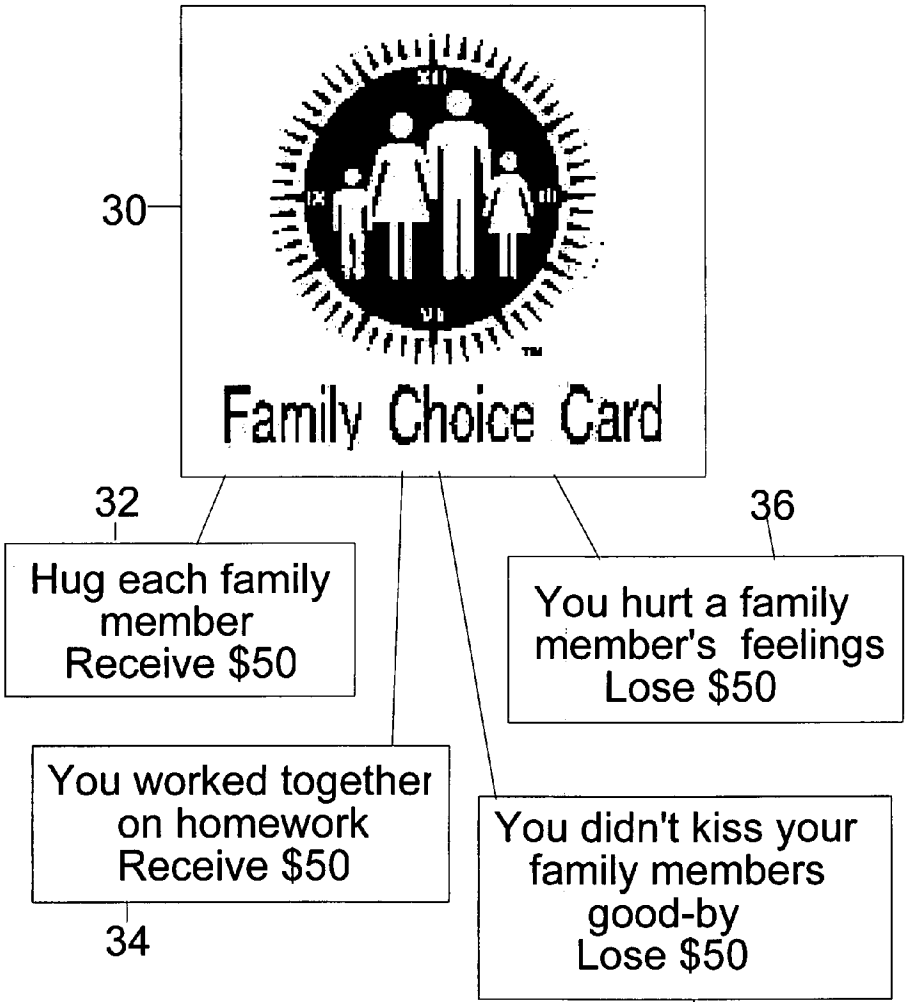
FIG. 3 is a plan view of several examples of game choice cards.

Family choice cards are labeled as such on one side of each card as illustrated in FIG. 3 where family choice card 30 is seen imprinted with the logo of the family vacation game. On the other side of each family choice card there is either a reward or penalty instruction. The instruction side of family choice card 32 describes a player hugging each member of the family. This positive behavior earns the player a reward of $50. Another family choice card 34 describes another positive family oriented behavior (working together on homework) which behavior is also rewarded with a payment of $50. Family choice cards may also describe negative behaviors and when chosen penalize a player. Choosing family choice cards 36 and 38 result in players being penalized $50, in one instance for hurting a family member's feelings and, in the other, for not kissing family members good-by when leaving. Players continue along the game space path until all players reach end space 24, which in the embodiment illustrated in FIG. 1 is depicted as a map of the contiguous United States.

When landed on by a player, some game spaces explain that the landed player is saving some of his or her money. For example, when a player lands on a game space that indicates the player is saving for college, putting money in a retirement fund, or has a general savings account the player will have to take $50 from his or her vacation fund and deposit it into the bank's savings account holding space 28*b*. The Banker keeps track of the amounts put into savings because each player's savings are returned to the saving player with interest at the end of the game.

If a player should land on a Everyone Gets Paid game space everyone collects a paycheck of $100 from the bank to add to their vacation fund. A player is still entitled to collect their pay even if they have already reached ending space 24.

If a player should run out of money, the player can borrow from the bank by depositing an IOU note with the bank. The borrowed funds must be repaid as soon as the borrowing player has accumulated the amount borrowed including the 10% interest that is the price a player must pay for borrowing money.

Once the last family member reaches the ending space, the entire family totals all the money accumulated by all the family members including the 10% interest earned by the family members who set money aside for college, retirement, and/or savings. Compare the total accumulated to the amount on your budget sheet, which is the amount of funds the family will need to be able to go on their dream vacation. If the funds accumulated are equal to or exceed the amount needed as stated on the budge sheet, start packing and Bon Voyage! If however, the amount accumulated is less than the amount required for the vacation, the players may decide to play again to earn more money, revise their budget by cutting some costs of the trip, for example, the family may decide to drive to their destination instead of flying or deciding to spend more time hiking and spending time on the beach instead of spending money on more expensive types of entertainment. Or, the family may decide to postpone their vacation for another time.

Thus, it has been shown that The Family Vacation Game provides a way for families to spend more time together reconnecting and growing as a unit. Working together through the various life situations encountered while playing the game, family members are provided with opportunities to develop appreciation for the strengths of their fellow family member and also learn to accept the imperfections of each member. It is precious times like these that helps create family bonds that can last a lifetime.

The foregoing description, for purposes of explanation, uses specific and defined nomenclature to provide a thorough understanding of the invention. However, it will be apparent to one skilled in the art that the specific details are not required in order to practice the invention. For example, a family unit could be replace by a unit made up of girl or boy scouts, members of a club, members of a larger family unit, students from a particular class, and so forth. Thus, the foregoing description of the specific embodiment is presented for purposes of illustration and description and is not intended to be exhaustive or to limit the invention to the precise form disclosed. Those skilled in the art will recognize that many changes may be made to the features, embodiments, and methods of making the embodiments of the invention described herein without departing from the spirit and scope of the invention. Furthermore, the present invention is not limited to the described methods, embodiments, features or combinations of features but include all the variation, methods, modifications, and combinations of features within the scope of the appended claims. The invention is limited only by the claims.

What is claimed is:

1. A method of playing a family vacation board game, wherein family members plan and play to save a predetermined amount of game currency required for the family members to go on a dream vacation, comprising the steps of:

a) providing a game board having a start space, an end space, and a path having a plurality of game spaces leading from said start space to said end space, wherein a play instruction is presented on each of said game spaces;

b) providing a first chance means;

c) providing a set of tokens where each of said tokens represents a player and said player's space position on said path;

d) choosing a player to be a game banker responsible for distributing the game currency;

e) providing a predetermined amount of game currency to each player and a predetermined amount of said currency to said game banker;

f) providing a plurality of reward choice cards and a plurality of penalty choice cards, respectively providing rewards and penalties during the play, said reward or penalty comprising a reward or penalty of a predetermined amount of said game currency to be distributed or collected, respectively by said game banker;

g) players selecting a vacation destination;

h) players determining said vacation expense;

i) players selecting a first player;

j) having first through subsequent players each move their player space position token sequentially along said game path spaces in turn according to a number indicated by said first chance means wherein each player must follow the play instruction given on the game space reached or must follow the play instruction given on the choice card allocated by said game space instruction;

k) awarding or penalizing players according to said play instruction presented on said game space or presented on said choice card, and l) when all players reach the end space, determining if the predetermined amount of money required for the family to go on their dream vacation has been accumulated by the players thereby resulting in either all said players winning or losing.

2. The method of playing a family vacation board game, as recited in claim 1, further disclosing wherein said first chance means is a set of die.

3. The method of playing a family vacation board game, as recited in claim 1, further disclosing wherein said determining said vacation expense for said vacation includes determining a budget for all trip costs.

4. The method of playing a family vacation board game, as recited in claim 3, further disclosing wherein a budget sheet is used to determine said budget for all trip costs.

5. The method of playing a family vacation board game, as recited in claim 1, further disclosing wherein said end space comprises a map on which vacation sites are indicated.

6. The method of playing a family vacation board game, as recited in claim 1, further disclosing wherein when all players reach the end space, if the amount of money accumulated by the players is equal to or greater than the predetermined amount of money required for the family to go on their dream vacation, the family has earned their vacation.

7. The method of playing a family vacation board game, as recited in claim 1, further disclosing wherein when all players reach the end space, if the amount of money accumulated by the players is not equal to or is less than the money required for the family to go on their dream vacation, the family must either repeat the steps recited in claim 1 as many times as needed to accumulate said predetermined amount of money required for the family to go on their dream vacation or re-budget their vacation.

8. The method of playing a family vacation board game, as recited in claim 1, further disclosing wherein the first player is the youngest player.

9. The method of playing a family vacation board game, as recited in claim 1, further disclosing wherein when all of said players have reached the end space said players are allocated interest from said bank on game currency said players placed into a savings account.

10. The method of playing a family vacation board game, as recited in claim 1, further disclosing wherein one side of said playing board is marked for use as said bank.

* * * * *